United States Patent [19]

Pennebaker, Jr.

[11] 3,997,113

[45] Dec. 14, 1976

[54] HIGH FREQUENCY ALTERNATING FIELD CHARGING OF AEROSOLS

[75] Inventor: William Boone Pennebaker, Jr., Carmel, N.Y.

[73] Assignee: International Business Machines Corporation, Armonk, N.Y.

[22] Filed: Dec. 31, 1975

[21] Appl. No.: 645,854

[52] U.S. Cl. ..... 239/15; 101/DIG. 13; 346/159; 346/75

[51] Int. Cl.[2] ..... B05B 5/08

[58] Field of Search ..... 346/74 J, 75, 74 ES; 101/DIG. 13, 1; 239/3, 15

[56] References Cited

UNITED STATES PATENTS

| | | | |
|---|---|---|---|
| 2,577,894 | 12/1951 | Jacob | 346/75 |
| 2,858,798 | 11/1958 | Sedlacsik | 239/15 X |
| 3,777,214 | 12/1973 | Taylor et al. | 101/DIG. 13 |

OTHER PUBLICATIONS

B529,214, Apr., 1976, Watanabe et al., 346/74 ES.

*Primary Examiner*—John J. Love
*Attorney, Agent, or Firm*—J. Jancin, Jr.

[57] ABSTRACT

Apparatus for high frequency alternating electric field charging of aerosol particles in the form of an ink mist which may subsequently be used for ink mist printing. A charging electrode excited by a high frequency alternating voltage source is used to produce a charging field. The charging field produced by the high frequency A.C. voltage is maintained at a predetermined frequency to avoid attracting the charged particles to the charging electrode, thereby avoiding precipitation on this electrode and allowing substantially higher voltages to be applied to the charging electrode.

8 Claims, 1 Drawing Figure

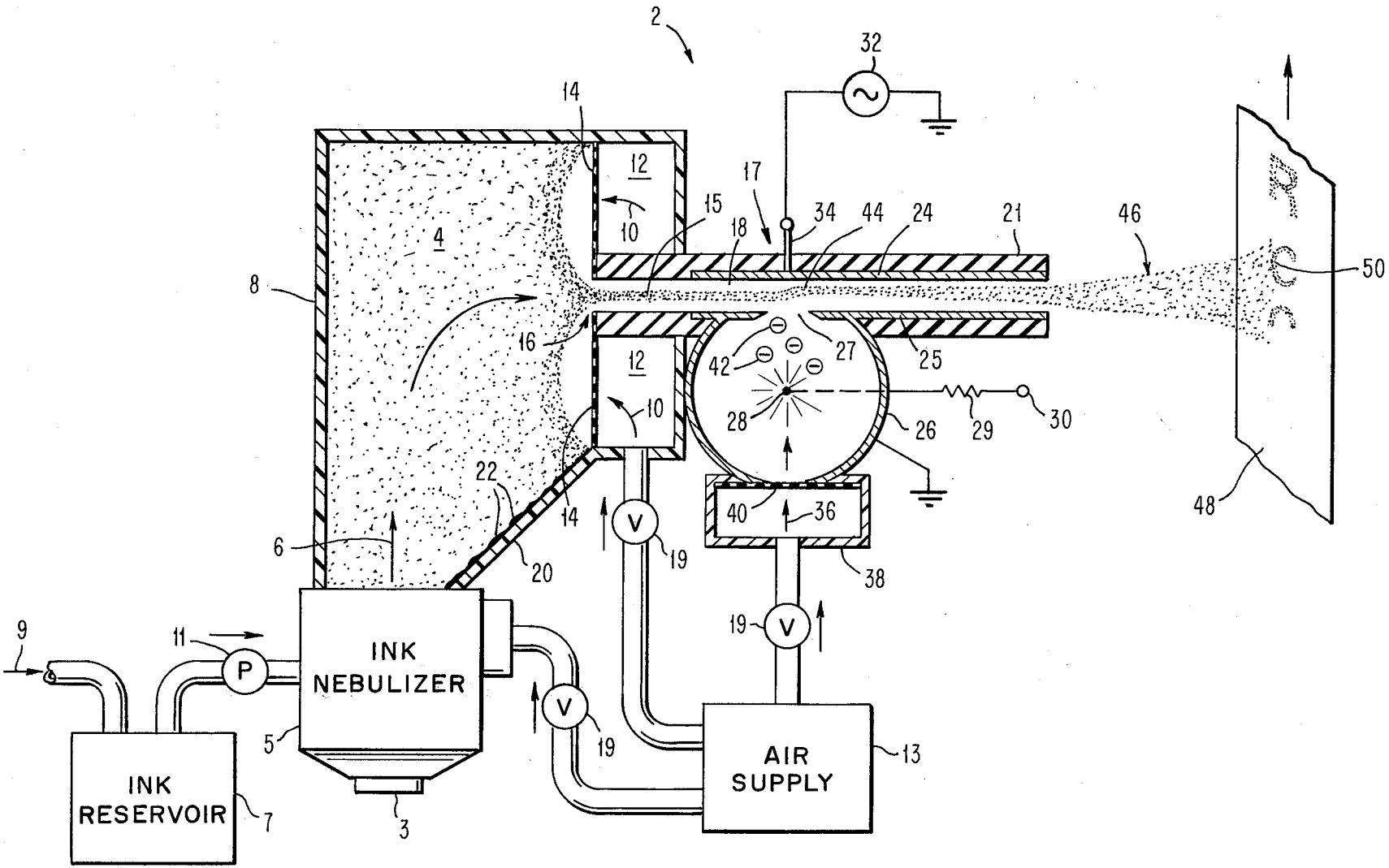
AIR SUPPLY
INK NEBULIZER
INK RESERVOIR

HIGH FREQUENCY ALTERNATING FIELD CHARGING OF AEROSOLS

BACKGROUND OF THE INVENTION

1. Field of the Invention

This invention relates generally to apparatus for charging particles and more specifically to apparatus for high frequency A. C. field charging of aerosol particles for employment in an ink mist printing operation.

2. Prior Art

The charging of aerosol particles in an ink mist printing operation is usually accomplished by a D. C. charging electrode. In such a charging system, generally referred to as electrostatic charging, the aerosol particles are charged by ions which are drawn from a corona source by a D. C. charging electrode. An electric field is produced in the passage between the corona source and the D. C. charging electrode which effectively draws ions from the corona. The aerosol particles when passing through this passage concentrate the electric field lines such that ions are drawn to their surfaces.

While the electrostatic charging method described above produces a charged particle suitable for use in a printing operation, the practice of this method has been hampered by precipitation of charged particles to the D. C. charging electrode. As the particles are charged they are also attracted to the D. C. charging electrode. In other words, the same electric field which charges the particles also causes them to precipitate. This precipitation eventually begins to block the passage in which the charging is done, and may cause electrical shorts between the electrodes if the particles are electrically conductive. To reduce the amount of charged aerosol particles which precipitate to the D. C. charging electrode, guard flows have been used. Even though guard flows eliminate some precipitation in the D. C. charging system, they have proven to be very ineffective in eliminating a substantial portion of the precipitate to the charging electrode over extended periods of operation or charging.

The employment of A. C. and transient voltages in electrostatic precipitation operations is known. However, previously known methods and apparatus for electrostatically precipitating particles have utilized A. C. and transient voltages as charging sources for the corona to generate a more intense corona and thus produce pulses of ions to impart an electrical charge to the aerosol particles. It is also known in the electrostatic precipitation art that an R. F. ripple can be superimposed on the constant potential supplied to ionizing wires in the corona source. This has the effect of increasing corona emission to the charging region. The precipitation of aerosol particles in the examples mentioned above is not retarded, but is increased by superimposing A. C. and transient voltages on potentials applied to the corona source.

It is also known to use low frequency A. C. voltage sources to produce pulses of ions. When using low frequency A. C. sources, the aerosol particles are charged directly in the corona. This results in pulses of charged particles rather than a continuous stream of uniformly charged particles.

OBJECT OF THE INVENTION

It is therefore an object of this invention to substantially eliminate precipitation of charged particles on charging electrodes in aerosol charging systems.

It is another object of this invention to uniformly charge a continuously moving aerosol stream.

SUMMARY OF THE INVENTION

The above objects are accomplished through the use of a high frequency alternating voltage source which is used in place of a standard D. C. voltage to create a charging field. The ions used to charge the aerosol particles are drawn from the corona under the action of a small D. C. electrical field produced by the corona itself. The charging field produced by the high frequency A. C. voltage source is maintained at a level sufficient enough to impart a charge to the aerosol particle and at a frequency high enough to avoid repelling or attracting the aerosol particles. An uncharged aerosol, directed through a passage between the corona and the high frequency voltage source, is charged by ions present in the passage. The charged particles are then projected onto a surface to form a discernible representation thereon.

The foregoing and other objects, features and advantages of the invention will be apparent from the following more particular description of the preferred embodiment of the invention, as illustrated in the accompanying drawing.

BRIEF DESCRIPTION OF THE DRAWING

The FIGURE shows diagrammatically a preferred embodiment of the aerosol charger in accordance with this invention.

DESCRIPTION OF THE PREFERRED EMBODIMENT

Referring to the drawing, there is shown a high frequency A. C. field aerosol charger of this invention indicated generally by the numeral 2, including a charging station 17 for charging the uncharged ink aerosol particles 4 as they travel through the charging station. The nebulization process, in which a very fine mist can be generated, is used in this invention to produce aerosol particles 4. The nebulization process is described generally in the following co-pending applications assigned to the same assignee as the present invention. Ser. No. 537,801, filed Dec. 1974, and entitled "Selective Wetting Using a Micromist of Particles ", now U.S. Pat. No. 3,959,798 by Hochberg, et al.; Ser. No. 576,407, filed May 19, 1975, by Hochberg, et al., and entitled "Micromist Jet Printer", and Ser. No. 581,058, filed May 1975, by Hochberg, et al., and entitled "Method and Apparatus for Recording Information on a Recording Surface Through the Use of Nondirected Particles." There are, of course, other ways in which a relatively high density of aerosol particles could be produced. For example, an aerosol could be prduced by spinning liquid sheets and letting the sheets break up into droplets. The commonly used canned dispenser is another possibility for making an aerosol but typically the drops produced in such a dispenser are too large for ink mist printing operations.

As shown in the drawing, the ink nebulizer comprises a housing 5 filled with a liquid ink bath with a transducer 3 placed on the lower outer edge thereof. The liquid bath in housing 5 is supplied from ink reservoir 7 through pump 11. The ink reservoir 7 is filled from a larger source (not shown) through line 9.

The transducer 3, when activated at a frequency on the order of 1 MHz, emits ultrasonic vibrations which act to excite or energize the ink bath in housing 5 producing nebulized ink particles 4 in the upper space of housing 5. The 1 MHz signal produces droplets having a drop size of about 3 microns in diameter.

A carrier stream of air 6 is fed from an air supply 13 through valve 19 to the upper space of housing 5. The ink aerosol particles 4, when formed, become entrained in the carrier stream of air 6 and travel out of housing 5 into aerosol chamber 8. As understood by those skilled in the art, any of a variety of inks may readily be employed for purposes of this invention.

There are three air streams used in this charging system, with air supply 13 serving as a common source for all three streams. As noted, the first air stream 6 brings aerosol particles 4 into the charging system from nebulizer 5. Another air stream 36 supplies a small bias flow through corona housing 26. This flow keeps corona housing 26 clean by preventing any aerosol particles 4 from settling therein. A third air stream in the form of a guard flow 10 introduces a layer of clean air into the top and bottom guard flow cavities 12. The guard flow of air 10 encircles carrier stream 6 containing aerosol particles 4 and compresses it into a stream or flow 15 of narrow width before it enters orifice 16 leading to charging station 17. This continues flow of aerosol particles 15 is constrained to the center of passage 18 between the plates 24 and 25 in the field electrode assembly. It is understood by those skilled in the art that the air streams as used above could readily be supplied from separate sources for purposes of this invention.

The guard flow cavities 12 are located within aerosol chamber 8 adjacent charging station 17 and encircle nozzle structure 21. The guard flow of air 10 which enters the cavities 12 exits into aerosol chamber 8 through small openings within porous filters 14. This guard flow of air 10 keeps aerosol particles 4 away from the edges of orifice 16 in nozzle 21 by shaping aerosol particles 4 into a ribbon or flow 15 of narrow width. This continuous flow of aerosol particles 15, still entrained in air stream 6, travels through passage 18 to charging station 17 where the aerosol is charged.

The aerosol chamber 8 is also provided with a lower inclined wall 20 which returns to nebulizer 5, ink 22 formed from aerosol particles which settle to inclined wall 20 under the action of gravity.

The charging station 17 is comprised of a high frequency alternating voltage 32, a field electrode assembly 24, an electrically grounded corona housing 26, a fine wire electrode 28 which forms the corona discharge, and an air flow cavity 38 with a porous filter 40 placed therein. A field electrode assembly, comprised of two plates 24 and 25 which are located on the upper and lower inner walls of nozzle 21 and comprised of two plates spaced a small distance apart, provide a passage 18 for aerosol particles 4 to travel through. A high frequency charging field for aerosol particles 4 is formed in this passage 18 between plates 24 and 25 in the field electrode assembly. The corona housing 26 and plate 25 are located on the lower side of charging station 17. The plate 25 is electrically connected to corona housing 26 and is also grounded. The ions produced by corona wire 28 are drawn through opening 27 in corona housing 28 under the action of a small D. C. electrical field produced by corona wire 28 itself during production of the ions. The high frequency A. C. voltage generator 32 is connected to plate 24 which is positioned directly opposite opening 27 in corona housing 26. The flow 36 of clean air enters air flow cavity 38 where it then enters corona housing 26 through porous filter 40 which separates corona housing 26 and air flow cavity 38. This small corona flow 36 keeps corona housing 26 clean by preventing any aerosol particle 4 from settling therein. This flow also counteracts the gravitational settling of aerosol particles 4 toward lower plate 25. The effect of corona flow 36 on the deposit flow of aerosol particles 15 can be seen in the area denoted by numeral 44.

The potential applied to the corona in this invention is a function of the amount of current to be produced and the type of corona in use. A fine wire electrode 28 with cylindrical symmetry as used in this charging station 17 operates at a potential of about 5–7 kilovolts which is supplied from source 30 through resistor 29. For purposes of this invention, the potential of source 30 could be either positive or negative.

The frequency used for the high frequency generator 32 should be greater than 1 kilo hertz for air velocities through the charge plates on the order of 300 cm/sec. if precipitation to the charge plates is to be avoided. An optimum charging efficiency is reached at a frequency of about 30–100 kilo hertz, and efficiency decreases slowly with increasing frequency above that optimum. The optimum frequency range is reached when ions 42 are no longer drawn to the charge plates, and thus remain in the charging region for a longer period of time.

A small D. C. bias may be added in series with the high frequency A. C. voltage generator 32 to enhance the current drawn from corona wire electrode 28. The potential on the D. C. bias would only be a fraction of the potential applied to a standard D. C. charging electrode. As this small bias, if added, is intended only for bias purposes, any-charging of aerosol particles 4 is negligible.

The charging rate of aerosol particles 4 is a function of time, and the high frequency A. C. fields, associated with the charging, oscillate many times during one particle transit through charging station 17. For purposes of clarifying this invention, an high frequncey A. C. field will charge aerosol particles to a value that would be given by a standard D. C. field. However, the rate at which the high frequency A. C. field will charge is going to be slower than the same D. C. field because the high frequency A. C. field is charging only during the peak portion of the cycle as it approaches its saturation charge. If saturation charge is not reached, less charge will exist on the particle in the high frequency A. C. charging system than would exist in the same D. C. system.

A higher charge on an aerosol particle can be obtained in a D. C. field than in an A. C. field up to a point. When higher fields are used, the D. C. field causes precipitation whereas the high frequency A. C. field does not. (If maintained at a predetermined frequency). Even though the high frequency A. C. system isn't as effecient as the D. C. charging system, in the sense that a higher field is needed to get the same amount of charge, it does not cause a problem of precipitation associated with the D. C. system. If less precipitation exists on the charging electrode more charge can be imparted to the particles in transit through the charging system.

The high frequency A. C. generator 32 produces a high field between the electrode assembly 24 which allows a charging action to take place in the presence of the high field. This same field if maintained at a sufficiently high frequency does not perturb the trajectory of aerosol particles 4 in transit through passage 18. The ions 42 produced by corona wire electrode 28 have a substantially higher mobility than the aerosol particles 4 that are being charged and the aerosol particles 46 that have already been charged. This means that ions 42, drawn from corona wire electrode 28, can travel to the aerosol particles during one cycle of the alternating voltage without any perturbation of the path of travel of aerosol particles 4 due to that same A. C. field. In other words, a charging action is taking place in which ions 42 can traverse the distance needed to follow the field lines to aersol particles 4, without aerosol particles 4 being moved appreciably in that one A. C. cycle.

A small portion of aerosol particles 4 precipitate due to space charges that are created during the charging of the uncharged aerosol particles. A space charge is a distribution of point charges in space, produced by a collection of aerosol particles, each with a small charge thereon. If there is a net electric field in the space charge, the individual charged particles encounter a force, and that force always disperses the space charge or dilutes it. The dispersal of the space charge will eventually cause some aerosol particles 4 to precipitate after an extended period of operation. Therefore, the uncharged aerosol particles should stay in charging station 17 long enough to acquire an appreciable charge, but the velocity of flows 6, 10, and 36 are sufficient enough to remove the aerosol particles from station 17 before they precipitate.

The charged aerosol particles 46, after leaving charging station 17, are carried to a surface 48 which has a charged pattern 50 thereon. The surface 48 to which charged aerosol particles 46 are projected could be a sheet of dielectric paper, a copier drum, or even a sheet of Mylar. A charged pattern 50 exists on surface 48 in order for charged aerosol particles 46 to form a discernible representation thereon.

STATEMENT OF THE OPERATION

Referring to the drawing, the ink aerosol particles 4 are formed in housing 5 by a nebulization process. The particles 4 are then picked up by an air stream 6 which enters the uppermost part of nebulizing chamber 5 and are brought to an orifice 16 at the inlet to charging station 17. The aerosol particles 4, before entering nozzle 21 are subjected to a guard flow 10 of clean air which forms the aerosol particles into a ribbon or flow 15. This continuous flow of aerosol particles 15, still entrained in air stream 6, is then carried through passage 18 and charging station 17. An additional flow of clean air 36 is introduced through the corona housing 26 to insure that no particles settle into corona housing 26 and collect on corona wire 28 where they can cause problems in its operation.

A charging field is produced by the high freqency A. C. generator 32 in passage 18 between plates 24 and 25 in the field electrode assembly. A small D. C. field due to the presence of the corona serves to attract ions 42 into the region between plates 24 and 25. Once a mixture of ions 42 and aerosol particles 4 is formed in passage 18 the field produced by the high frequency A. C. generator 32 will cause ions to be attracted to particles 4.

Once particles 4 are charged they are carried out of charging station 17 by moving air stream 6. This air stream 6 is maintained at a velocity which prevents particles 4 from precipitating spontaneously to the charging electrode due to the space charge factor. The charged particles 46 are then introduced to surface 48 in the form of a low velocity jet. The charged particles 46 impact surface 48 at a very low velocity in order to avoid any wetting action outside of charged pattern 50. The printing process and the development of pattern 50 take place by action of the charge on surface 48 drawing in charged particles 46.

While the invention has been shown and described with reference to a preferred embodiment thereof, it will be appreciated by those skilled in the art that variations in form may be made therein without departing from the spirit and scope of the invention.

What is claimed is:

1. Apparatus for charging aerosol particles and for substantially eliminating precipitation of charged aerosol particles on the charging electrode comprising in combination:
   - an aerosol generating means for producing aerosol particles;
   - a chamber attached to said aerosol generating means for receiving said aerosol particles;
   - a nozzle connected to said chamber and spaced from said aerosol generating means, said nozzle protruding into said chamber and forming a passageway for said aerosol particles;
   - conductive means affixed to the inner surfaces of said nozzle for providing a charging region along the length of said passageway;
   - a corona housing connected to the lower side of said nozzle and containing therein a corona wire electrode for producing ions, said corona housing opening into said nozzle for providing ions to said charging region;
   - a high frequency A. C. generator opposite said opening in said corona source for producing a charging field in the region surrounded by said conductive means;
   - an air flow entering the chamber for compressing the aerosol to a cross-sectional area less than the diameter of said passageway in said nozzle; and
   - an air transport means for forming a continuous air flow carrier stream for said aerosol particles through said chamber and said nozzle where a charge is imparted to the aerosol particles by the ions in said charging field in order that a printing operation can be performed on a document passing adjacent the outlet of said nozzle.

2. The apparatus of claim 1 wherein the charging field produced by said high frequency generator being sufficient to cause substantial charging of aerosol particles without causing perturbation of the trajectory of aerosol particles in transit through the passageway.

3. The apparatus of claim 1 wherein said conductive means is comprised of two plates, with one plate affixed to the upper inner surface of the nozzle and electrically connected to said high frequency A. C. generator and the other plate affixed to the lower inner surface of the nozzle and electrically connected to said corona housing.

4. The apparatus of claim 1 containing an air source for producing an air flow through said corona housing opening to prevent said aerosol particles from contaminating the corona housing and the corona wire electrode therein.

5. The apparatus of claim 1 wherein said chamber includes a fluid returning means for returning to said aerosol generating means particles which do not enter said passage.

6. The apparatus of claim 2 wherein the frequency of the high frequency generator is greater than 1 KHz and less than 100 KHz to prevent precipitation of charged particles to the charging electrode.

7. The apparatus of claim 4 wherein said corona housing is located on the lower side of said nozzle in order that the gravitational forces which cause precipitation of aerosol particles can be counteracted by the said air flow through the corona housing.

8. Apparatus for charging aerosol particles and for substantially eliminating precipitation of charged aerosol particles on the charging electrode comprising in combination:

an aerosol generating means for producing aerosol particles;

a chamber attached to said aerosol generating means for receiving said aerosol particles;

a nozzle connected to said chamber and spaced from said aerosol generating means, said nozzle protruding into said chamber and forming a passageway for said aerosol particles;

conductive means affixed to the inner surfaces of said nozzle for providing a charging region along the length of said passageway;

a corona housing connected to the lower side of said nozzle and containing therein a corona wire electrode for producing ions, said corona housing opening into said nozzle for providing ions to said charging region;

a high frequency A. C. generator opposite said opening in said corona source for producing a charging field in the region surrounded by said conductive means;

a porous baffle means in said chamber to form a cavity around the end of said nozzle protruding into said chamber;

an air compressor means to provide an air stream in said cavity for forming said aerosol into a cross-sectional area less than the diameter of said passageway in said nozzle; and an air transport means for forming a continuous air flow carrier stream for said aerosol particles through said chamber and said nozzle where a charge is imparted to the aerosol particles by the ions present in the charging field in order that a printing operation can be performed on a document passing adjacent the outlet of said nozzle.

* * * * *